US007498999B2

(12) United States Patent
Shtrom

(10) Patent No.: US 7,498,999 B2
(45) Date of Patent: Mar. 3, 2009

(54) CIRCUIT BOARD HAVING A PERIPHERAL ANTENNA APPARATUS WITH SELECTABLE ANTENNA ELEMENTS AND SELECTABLE PHASE SHIFTING

(75) Inventor: Victor Shtrom, Sunnyvale, CA (US)

(73) Assignee: Ruckus Wireless, Inc., Sunnyvale, CA (US)

( * ) Notice: Subject to any disclaimer, the term of this patent is extended or adjusted under 35 U.S.C. 154(b) by 419 days.

(21) Appl. No.: 11/265,751

(22) Filed: Nov. 1, 2005

(65) Prior Publication Data

US 2006/0109067 A1 May 25, 2006

Related U.S. Application Data

(63) Continuation-in-part of application No. 11/022,080, filed on Dec. 23, 2004, now Pat. No. 7,193,562.

(60) Provisional application No. 60/630,499, filed on Nov. 22, 2004.

(51) Int. Cl.
*H01Q 3/36* (2006.01)
*H01P 1/18* (2006.01)

(52) U.S. Cl. ..... 343/853; 333/164; 333/139

(58) Field of Classification Search ..... 333/139, 333/156, 164; 343/853
See application file for complete search history.

(56) References Cited

U.S. PATENT DOCUMENTS

| | | | | |
|---|---|---|---|---|
| 723,188 | A | 3/1903 | Tesla | |
| 725,605 | A | 4/1903 | Tesla | |
| 1,869,659 | A | 8/1932 | Broertjes | |
| 2,292,387 | A | 8/1942 | Markey et al. | |
| 3,488,445 | A | 1/1970 | Chang | |
| 3,568,105 | A * | 3/1971 | Felsenheld | 333/161 |
| 3,967,067 | A | 6/1976 | Potter | |
| 3,982,214 | A * | 9/1976 | Burns | 333/164 |
| 3,991,273 | A | 11/1976 | Mathes | |
| 4,001,734 | A * | 1/1977 | Burns | 333/164 |
| 4,176,356 | A | 11/1979 | Foster et al. | |

(Continued)

FOREIGN PATENT DOCUMENTS

| | | |
|---|---|---|
| EP | 0 534 612 | 3/1993 |

(Continued)

OTHER PUBLICATIONS

"Authorization of Spread Spectrum Systems Under Parts 15 and 90 of the FCC Rules and Regulations," Rules and Regulations Federal Communications Commission, 47 CFR Part 2, 15, and 90, Jun. 18, 1985.

(Continued)

*Primary Examiner*—Benny Lee
(74) *Attorney, Agent, or Firm*—Carr & Ferrell LLP

(57) ABSTRACT

A circuit board for wireless communications includes communication circuitry for modulating and/or demodulating a radio frequency (RF) signal and an antenna apparatus for transmitting and receiving the RF signal, the antenna apparatus having selectable antenna elements located near one or more peripheries of the circuit board and selectable phase shifting. A switching network couples one or more of the selectable elements to the communication circuitry and provides impedance matching regardless of which or how many of the antenna elements are selected, and includes a selectable phase shifter to allow the phase of the antenna elements to be shifted by 180 degrees. The phase shifter includes a first RF switch and two ¼-wavelength delay lines of PCB traces or delay elements and a second RF switch. The phase shifter selectively provides a straight-through path, a 180 degree phase shift, a high impedance state, or a notch filter.

33 Claims, 9 Drawing Sheets

U.S. PATENT DOCUMENTS

| | | | | |
|---|---|---|---|---|
| 4,193,077 | A | 3/1980 | Greenberg et al. | |
| 4,305,052 | A | 12/1981 | Baril et al. | |
| 4,554,554 | A | 11/1985 | Olesen et al. | |
| 4,733,203 | A | 3/1988 | Ayasli | |
| 4,814,777 | A | 3/1989 | Monser | |
| 5,063,574 | A | 11/1991 | Moose | |
| 5,173,711 | A | 12/1992 | Takeuchi et al. | |
| 5,208,564 | A * | 5/1993 | Burns et al. | 333/164 |
| 5,220,340 | A | 6/1993 | Shafai | |
| 5,282,222 | A | 1/1994 | Fattouche et al. | |
| 5,291,289 | A | 3/1994 | Hulyalkar et al. | |
| 5,311,550 | A | 5/1994 | Fouche et al. | |
| 5,559,800 | A | 9/1996 | Mousseau et al. | |
| 5,754,145 | A | 5/1998 | Evans | |
| 5,767,809 | A | 6/1998 | Chuang et al. | |
| 5,786,793 | A | 7/1998 | Maeda et al. | |
| 5,802,312 | A | 9/1998 | Lazaridis et al. | |
| 5,964,830 | A | 10/1999 | Durrett | |
| 5,990,838 | A | 11/1999 | Burns et al. | |
| 6,034,638 | A | 3/2000 | Thiel et al. | |
| 6,091,364 | A | 7/2000 | Murakami et al. | |
| 6,094,177 | A | 7/2000 | Yamamoto | |
| 6,169,523 | B1 | 1/2001 | Ploussios | |
| 6,266,528 | B1 | 7/2001 | Farzaneh | |
| 6,292,153 | B1 | 9/2001 | Aiello et al. | |
| 6,307,524 | B1 | 10/2001 | Britain | |
| 6,317,599 | B1 | 11/2001 | Rappaport et al. | |
| 6,326,922 | B1 | 12/2001 | Hegendoerfer | |
| 6,337,628 | B2 | 1/2002 | Campana, Jr. | |
| 6,337,668 | B1 | 1/2002 | Ito et al. | |
| 6,339,404 | B1 | 1/2002 | Johnson et al. | |
| 6,345,043 | B1 | 2/2002 | Hsu | |
| 6,356,242 | B1 | 3/2002 | Ploussios | |
| 6,356,243 | B1 | 3/2002 | Schneider et al. | |
| 6,356,905 | B1 | 3/2002 | Gershman et al. | |
| 6,377,227 | B1 | 4/2002 | Zhu et al. | |
| 6,392,610 | B1 | 5/2002 | Braun et al. | |
| 6,404,386 | B1 | 6/2002 | Proctor, Jr. et al. | |
| 6,407,719 | B1 | 6/2002 | Ohira et al. | |
| RE37,802 | E | 7/2002 | Fattouche et al. | |
| 6,442,507 | B1 | 8/2002 | Skidmore et al. | |
| 6,445,688 | B1 | 9/2002 | Garces et al. | |
| 6,493,679 | B1 | 12/2002 | Rappaport et al. | |
| 6,496,083 | B1 | 12/2002 | Kushitani et al. | |
| 6,498,589 | B1 | 12/2002 | Horii | |
| 6,499,006 | B1 | 12/2002 | Rappaport et al. | |
| 6,507,321 | B2 | 1/2003 | Oberschmidt et al. | |
| 6,586,786 | B2 | 7/2003 | Kitazawa et al. | |
| 6,611,230 | B2 * | 8/2003 | Phelan | 342/373 |
| 6,625,454 | B1 | 9/2003 | Rappaport et al. | |
| 6,633,206 | B1 | 10/2003 | Kato | |
| 6,642,889 | B1 | 11/2003 | McGrath | |
| 6,674,459 | B2 | 1/2004 | Ben-Shachar et al. | |
| 6,701,522 | B1 | 3/2004 | Rubin et al. | |
| 6,725,281 | B1 | 4/2004 | Zintel et al. | |
| 6,753,814 | B2 | 6/2004 | Killen et al. | |
| 6,762,723 | B2 | 7/2004 | Nallo et al. | |
| 6,779,004 | B1 | 8/2004 | Zintel | |
| 6,819,287 | B2 | 11/2004 | Sullivan et al. | |
| 6,839,038 | B2 | 1/2005 | Weinstein | |
| 6,859,176 | B2 | 2/2005 | Choi | |
| 6,859,182 | B2 | 2/2005 | Horii | |
| 6,876,280 | B2 | 4/2005 | Nakano | |
| 6,888,504 | B2 | 5/2005 | Chiang et al. | |
| 6,888,893 | B2 | 5/2005 | Li et al. | |
| 6,892,230 | B1 | 5/2005 | Gu et al. | |
| 6,903,686 | B2 | 6/2005 | Vance et al. | |
| 6,906,678 | B2 | 6/2005 | Chen | |
| 6,910,068 | B2 | 6/2005 | Zintel et al. | |
| 6,924,768 | B2 | 8/2005 | Wu et al. | |
| 6,931,429 | B2 | 8/2005 | Gouge et al. | |
| 6,941,143 | B2 | 9/2005 | Mathur | |
| 6,950,019 | B2 | 9/2005 | Bellone et al. | |
| 6,961,028 | B2 | 11/2005 | Joy et al. | |
| 6,965,353 | B2 | 11/2005 | Shirosaka et al. | |
| 6,973,622 | B1 | 12/2005 | Rappaport et al. | |
| 6,975,834 | B1 | 12/2005 | Forster | |
| 6,980,782 | B1 | 12/2005 | Braun et al. | |
| 7,023,909 | B1 | 4/2006 | Adams et al. | |
| 7,034,770 | B2 | 4/2006 | Yang et al. | |
| 7,043,277 | B1 | 5/2006 | Pfister | |
| 7,050,809 | B2 | 5/2006 | Lim | |
| 7,064,717 | B2 | 6/2006 | Kaluzni et al. | |
| 7,085,814 | B1 | 8/2006 | Gandhi et al. | |
| 7,088,299 | B2 | 8/2006 | Siegler et al. | |
| 7,089,307 | B2 | 8/2006 | Zintel et al. | |
| 7,130,895 | B2 | 10/2006 | Zintel et al. | |
| 7,171,475 | B2 | 1/2007 | Weisman et al. | |
| 7,277,063 | B2 | 10/2007 | Shirosaka et al. | |
| 7,312,762 | B2 | 12/2007 | Puente Ballarda et al. | |
| 2001/0046848 | A1 | 11/2001 | Kenkel | |
| 2002/0031130 | A1 | 3/2002 | Tsuchiya et al. | |
| 2002/0047800 | A1 | 4/2002 | Proctor, Jr. et al. | |
| 2002/0080767 | A1 | 6/2002 | Lee | |
| 2002/0084942 | A1 | 7/2002 | Tsai et al. | |
| 2002/0105471 | A1 | 8/2002 | Kojima et al. | |
| 2002/0112058 | A1 | 8/2002 | Weisman et al. | |
| 2002/0158798 | A1 | 10/2002 | Chiang et al. | |
| 2002/0170064 | A1 | 11/2002 | Monroe et al. | |
| 2003/0026240 | A1 | 2/2003 | Eyuboglu et al. | |
| 2003/0030588 | A1 | 2/2003 | Kalis et al. | |
| 2003/0063591 | A1 | 4/2003 | Leung et al. | |
| 2003/0122714 | A1 | 7/2003 | Wannagot et al. | |
| 2003/0169330 | A1 | 9/2003 | Ben-Schachar et al. | |
| 2003/0184490 | A1 | 10/2003 | Raiman et al. | |
| 2003/0189514 | A1 | 10/2003 | Miyano et al. | |
| 2003/0189521 | A1 | 10/2003 | Yamamoto et al. | |
| 2003/0189523 | A1 | 10/2003 | Ojantakanen et al. | |
| 2003/0210207 | A1 | 11/2003 | Suh et al. | |
| 2003/0227414 | A1 | 12/2003 | Saliga et al. | |
| 2004/0014432 | A1 | 1/2004 | Boyle | |
| 2004/0017310 | A1 | 1/2004 | Runkle et al. | |
| 2004/0017860 | A1 | 1/2004 | Liu | |
| 2004/0027291 | A1 | 2/2004 | Zhang et al. | |
| 2004/0027304 | A1 | 2/2004 | Chiang et al. | |
| 2004/0032378 | A1 | 2/2004 | Volman et al. | |
| 2004/0036651 | A1 | 2/2004 | Toda | |
| 2004/0036654 | A1 | 2/2004 | Hsieh | |
| 2004/0041732 | A1 | 3/2004 | Aikawa et al. | |
| 2004/0048593 | A1 | 3/2004 | Sano | |
| 2004/0058690 | A1 | 3/2004 | Ratzel et al. | |
| 2004/0061653 | A1 | 4/2004 | Webb et al. | |
| 2004/0070543 | A1 | 4/2004 | Masaki | |
| 2004/0080455 | A1 | 4/2004 | Lee | |
| 2004/0095278 | A1 | 5/2004 | Kanemoto et al. | |
| 2004/0114535 | A1 | 6/2004 | Hoffmann et al. | |
| 2004/0125777 | A1 | 7/2004 | Doyle et al. | |
| 2004/0190477 | A1 | 9/2004 | Olson et al. | |
| 2004/0203347 | A1 | 10/2004 | Nguyen | |
| 2004/0260800 | A1 | 12/2004 | Gu et al. | |
| 2005/0022210 | A1 | 1/2005 | Zintel et al. | |
| 2005/0041739 | A1 | 2/2005 | Li et al. | |
| 2005/0042988 | A1 | 2/2005 | Hoek et al. | |
| 2005/0074108 | A1 | 4/2005 | Zintel et al. | |
| 2005/0097503 | A1 | 5/2005 | Zintel et al. | |
| 2005/0128983 | A1 | 6/2005 | Kim et al. | |
| 2005/0135480 | A1 | 6/2005 | Li et al. | |
| 2005/0138137 | A1 | 6/2005 | Encarnacion et al. | |
| 2005/0138193 | A1 | 6/2005 | Encarnacion et al. | |
| 2005/0180381 | A1 | 8/2005 | Retzer et al. | |
| 2005/0188193 | A1 | 8/2005 | Kuehnel et al. | |
| 2005/0240665 | A1 | 10/2005 | Gu et al. | |
| 2005/0267935 | A1 | 12/2005 | Ghandi et al. | |
| 2006/0094371 | A1 | 5/2006 | Nguyen | |

| | | | |
|---|---|---|---|
| 2006/0098607 | A1 | 5/2006 | Zeng et al. |
| 2006/0123124 | A1 | 6/2006 | Weisman et al. |
| 2006/0123125 | A1 | 6/2006 | Weisman et al. |
| 2006/0123455 | A1 | 6/2006 | Pai et al. |
| 2006/0168159 | A1 | 7/2006 | Weisman et al. |
| 2006/0184661 | A1 | 8/2006 | Weisman et al. |
| 2006/0184693 | A1 | 8/2006 | Rao et al. |
| 2006/0187660 | A1 | 8/2006 | Rao et al. |
| 2006/0224690 | A1 | 10/2006 | Falkenburg et al. |
| 2006/0225107 | A1 | 10/2006 | Seetharaman et al. |
| 2006/0227761 | A1 | 10/2006 | Scott, III et al. |
| 2006/0239369 | A1 | 10/2006 | Lee |
| 2006/0291434 | A1 | 12/2006 | Gu et al. |
| 2007/0027622 | A1 | 2/2007 | Cleron et al. |
| 2007/0135167 | A1 | 6/2007 | Liu |

FOREIGN PATENT DOCUMENTS

| | | |
|---|---|---|
| EP | 1 376 920 | 6/2002 |
| EP | 1 315 311 | 5/2003 |
| EP | 1 450 521 | 8/2004 |
| EP | 1 608 108 | 12/2005 |
| JP | 2008/088633 | 2/1996 |
| JP | 2001/057560 | 2/2002 |
| JP | 2005/354249 | 12/2005 |
| JP | 2006/060408 | 3/2006 |
| WO | WO 90/04893 | 5/1990 |
| WO | WO 02/25967 | 3/2002 |
| WO | WO 03/079484 | 9/2003 |

OTHER PUBLICATIONS

"Authorization of spread spectrum and other wideband emissions not presently provided for in the FCC Rules and Regulations," Before the Federal Communications Commission, FCC 81-289, 87 F.C.C.2d 876, Jun. 30, 1981.

RL Miller, "4.3 Project X—A True Secrecy System for Speech," Engineering and Science in the Bell System, A History of Engineering and Science in the Bell System National Service in War and Peace (1925-1975), pp. 296-317, 1978, Bell Telephone Laboratories, Inc.

Chang, Robert W., "Synthesis of Band-Limited Orthogonal Signals for Multichannel Data Transmission," The Bell System Technical Journal, Dec. 1966, pp. 1775-1796.

Cimini, Jr., Leonard J, "Analysis and Simulation of a Digital Mobile Channel Using Orthogonal Frequency Division Multiplexing," IEEE Transactions on Communications, vol. Com-33, No. 7, Jul. 1985, pp. 665-675.

Saltzberg, Burton R., "Performance of an Efficient Parallel Data Transmission System," IEEE Transactions on Communication Technology, vol. Com-15, No. 6, Dec. 1967, pp. 805-811.

Weinstein, S. B., et al., "Data Transmission by Frequency-Division Multiplexing Using the Discrete Fourier Transform," IEEE Transactions on Communication Technology, vol. Com-19, No. 5, Oct. 1971, pp. 628-634.

Moose, Paul H., "Differential Modulation and Demodulation of Multi-Frequency Digital Communications Signals," 1990 IEEE,CH2831-6/90/0000-0273.

Casas, Eduardo F., et al., "OFDM for Data Communication Over Mobile Radio FM Channels-Part I: Analysis and Experimental Results," IEEE Transactions on Communications, vol. 39, No. 5, May 1991, pp. 783-793.

Casas, Eduardo F., et al., "OFDM for Data Communication over Mobile Radio FM Channels; Part II: Performance Improvement," Department of Electrical Engineering, University of British Columbia.

Chang, Robert W., et al., "A Theoretical Study of Performance of an Orthogonal Multiplexing Data Transmission Scheme," IEEE Transactions on Communication Technology, vol. Com-16, No. 4, Aug. 1968, pp. 529-540.

Gledhill, J. J., et al., "The Transmission of Digital Television in the UHF Band Using Orthogonal Frequency Division Multiplexing," Sixth International Conference on Digital Processing of Signals in Communications, Sep. 2-6, 1991, pp. 175-180.

Alard, M., et al., "Principles of Modulation and Channel Coding for Digital Broadcasting for Mobile Receivers," 8301 EBU Review Technical, Aug. 1987, No. 224, Brussels, Belgium.

Berenguer, Inaki, et al., "Adaptive MIMO Antenna Selection," Nov. 2003.

Gaur, Sudhanshu, et al., "Transmit/Receive Antenna Selection for MIMO Systems to Improve Error Performance of Linear Receivers," School of ECE, Georgia Institute of Technology, Apr. 4, 2005.

Sadek, Mirette, et al., "Active Antenna Selection in Multiuser MIMO Communications," IEEE Transactions on Signal Processing, vol. 55, No. 4, Apr. 2007, pp. 1498-1510.

Molisch, Andreas F., et al., "MIMO Systems with Antenna Selection-an Overview," Draft, Dec. 31, 2003.

Ken Tang, et al., "MAC Layer Broadcast Support in 802.11 Wireless Networks," Computer Science Department, University of California, Los Angeles, 2000 IEEE, pp. 544-548.

Ken Tang, et al., "MAC Reliable Broadcast in Ad Hoc Networks," Computer Science Department, University of California, Los Angeles, 2001 IEEE, pp. 1008-1013.

Vincent D. Park, et al., "A Performance Comparison of the Temporally-Ordered Routing Algorithm and Ideal Link-State Routing," IEEE, Jul. 1998, pp. 592-598.

Ian F. Akyildiz, et al., "A Virtual Topology Based Routing Protocol for Multihop Dynamic Wireless Networks," Broadband and Wireless Networking Lab, School of Electrical and Computer Engineering, Georgia Institute of Technology.

Dell Inc., "How Much Broadcast and Multicast Traffic Should I Allow in My Network," PowerConnect Application Note #5, Nov. 2003.

Toskala, Antti, "Enhancement of Broadcast and Introduction of Multicast Capabilities in RAN,"Nokia Networks, Palm Springs, California, Mar. 13-16, 2001.

Microsoft Corporation, "IEEE 802.11 Networks and Windows XP," Windows Hardware Developer Central, Dec. 4, 2001.

Festag, Andreas, "What is MOMBASA?" Telecommunication Networks Group (TKN), Technical University of Berlin, Mar. 7, 2002.

Hewlett Packard, "HP ProCurve Networking: Enterprise Wireless LAN Networking and Mobility Solutions," 2003.

Dutta, Ashutosh et al., "MarconiNet Supporting Streaming Media Over Localized Wireless Multicast," Proc. of the 2d Int'l Workshop on Mobile Commerce, 2002.

Dunkels, Adam et al., "Making TCP/IP Viable for Wireless Sensor Networks," Proc. of the 1st Euro. Workshop on Wireless Sensor Networks, Berlin, Jan. 2004.

Dunkels, Adam et al., "Connecting Wireless Sensornets with TCP/IP Networks," Proc. of the 2d Int'l Conf. on Wired Networks, Frankfurt, Feb. 2004.

Cisco Systems, "Cisco Aironet Access Point Software Configuration Guide: Configuring Filters and Quality of Service," Aug. 2003.

Hirayama, Koji et al., "Next-Generation Mobile-Access IP Network," Hitachi Review vol. 49, No. 4, 2000.

Pat Calhoun et al., "802.11r strengthens wireless voice," Technology Update, Network World, Aug. 22, 2005, http://www.networkworld.com/news/tech/2005/082208techupdate.html.

Areg Alimian et al., "Analysis of Roaming Techniques," doc.:IEEE 802.11-04/0377r1, Submission, Mar. 2004.

Information Society Technologies Ultrawaves, "System Concept / Architecture Design and Communication Stack Requirement Document,"Feb. 23, 2004.

Golmie, Nada, "Coexistence in Wireless Networks: Challenges and System-Level Solutions in the Unlicensed Bands," Cambridge University Press, 2006.

Mawa, Rakesh, "Power Control in 3G Systems," Hughes Systique Corporation, Jun. 28, 2006.

Wennstrom, Mattias et al., "Transmit Antenna Diversity in Ricean Fading MIMO Channels with Co-Channel Interference," 2001.

Steger, Christopher et al., "Performance of IEEE 802.11b Wireless LAN in an Emulated Mobile Channel," 2003.

Chang, Nicholas B. et al., "Optimal Channel Probing and Transmission Scheduling for Opportunistics Spectrum Access," Sep. 2007.

* cited by examiner

CIRCUIT BOARD HAVING A PERIPHERAL ANTENNA APPARATUS WITH SELECTABLE ANTENNA ELEMENTS AND SELECTABLE PHASE SHIFTING

CROSS-REFERENCE TO RELATED APPLICATIONS

This application is a continuation-in-part and claims the priority benefit of U.S. patent application Ser. No. 11/022,080, filed Dec. 23, 2004, entitled "Circuit Board Having a Peripheral Antenna Apparatus with Selectable Antenna Elements," now U.S. Pat. No. 7,193,562, which claims the priority benefit of U.S. Provisional Application No. 60/630,499, entitled "Method and Apparatus for Providing 360 Degree Coverage via Multiple Antenna Elements Co-located with Electronic Circuitry on a Printed Circuit Board Assembly," filed Nov. 22, 2004, the disclosures of which are hereby incorporated by reference. This application is also related to U.S. patent application Ser. No. 11/010,076, entitled "System and Method for an Omnidirectional Planar Antenna Apparatus with Selectable Elements," filed Dec. 9, 2004, now U.S. Pat. No. 7,292,198, which is hereby incorporated by reference.

BACKGROUND OF INVENTION

1. Field of the Invention

The present invention relates generally to wireless communications, and more particularly to a circuit board having a peripheral antenna apparatus with selectable antenna elements and selectable phase shifting.

2. Description of the Prior Art

In communications systems, there is an ever-increasing demand for higher data throughput and a corresponding drive to reduce interference that can disrupt data communications. For example, in an IEEE 802.11 network, an access point (i.e., base station) communicates data with one or more remote receiving nodes (e.g., a network interface card) over a wireless link. The wireless link may be susceptible to interference from other access points, other radio transmitting devices, changes or disturbances in the wireless link environment between the access point and the remote receiving node, and so on. The interference may be such to degrade the wireless link, for example by forcing communication at a lower data rate, or may be sufficiently strong to completely disrupt the wireless link.

One solution for reducing interference in the wireless link between the access point and the remote receiving node is to provide several omnidirectional antennas for the access point, in a "diversity" scheme. For example, a common configuration for the access point comprises a data source coupled via a switching network to two or more physically separated omnidirectional antennas. The access point may select one of the omnidirectional antennas by which to maintain the wireless link. Because of the separation between the omnidirectional antennas, each antenna experiences a different signal environment, and each antenna contributes a different interference level to the wireless link. The switching network couples the data source to whichever of the omnidirectional antennas experiences the least interference in the wireless link.

However, one limitation with using two or more omnidirectional antennas for the access point is that each omnidirectional antenna comprises a separate unit of manufacture with respect to the access point, thus requiring extra manufacturing steps to include the omnidirectional antennas in the access point. A further limitation is that the omnidirectional antenna typically comprises an upright wand attached to a housing of the access point. The wand typically comprises a rod exposed outside of the housing, and may be subject to breakage or damage.

Another limitation is that typical omnidirectional antennas are vertically polarized. Vertically polarized radio frequency (RF) energy does not travel as efficiently as horizontally polarized RF energy inside a typical office or dwelling space, additionally, most laptop computer network interface cards have horizontally polarized antennas. Typical solutions for creating horizontally polarized RF antennas to date have been expensive to manufacture, or do not provide adequate RF performance to be commercially successful.

A still further limitation with the two or more omnidirectional antennas is that because the physically separated antennas may still be relatively close to each other, each of the several antennas may experience similar levels of interference and only a relatively small reduction in interference may be gained by switching from one omnidirectional antenna to another omnidirectional antenna.

SUMMARY OF INVENTION

In one aspect, a system for selective phase shifting comprises an input port, a straight-through path coupled to the input port and including a first RF switch, a long path of predetermined length coupled to the input port and including a second RF switch coupled to a ground, and an output port coupled to the straight-through path and the long path. The predetermined length may comprise a 90 degree phase shift between the input port and the output port. The long path may comprise a first trace line of ¼-wavelength and a second trace line of ¼-wavelength, the first trace line and the second trace line selectively coupled to ground by the second RF switch.

In one aspect, a method for phase shifting an RF signal comprises receiving an RF signal at an input port, disabling a straight-through path coupled to the input port by applying a zero or reverse bias to a first RF switch included in the straight-through path, phase shifting the RF signal by enabling a long path of a predetermined length coupled to the input port by applying a zero or reverse bias to a second RF switch included in the long path, the second RF switch coupled to a ground, and transmitting the phase shifted RF signal to an output port coupled to the straight-through path and the long path.

In one aspect, an antenna apparatus having selectable antenna elements and selectable phase shifting comprises communication circuitry, a first antenna element, and a phase shifter. The communication circuitry is located in a first area of a circuit board and is configured to generate an RF signal into an antenna feed port of the circuit board. The first antenna element is located near a first periphery of the circuit board and is configured to produce a first directional radiation pattern when coupled to the antenna feed port. The phase shifter includes a straight-through path configured to selectively couple the antenna feed port to the first antenna element with a first RF switch, and further includes a long path of predetermined length configured to selectively couple the antenna feed port to the first antenna element with a second RF switch coupled to a ground. The phase shifter may be configured to selectively provide, between the antenna feed port and the first antenna element, a zero degree phase shift, a 180 degree phase shift, and/or isolation (high impedance) between the antenna feed port and the first antenna element.

BRIEF DESCRIPTION OF DRAWINGS

The present invention will now be described with reference to drawings that represent a preferred embodiment of the invention. In the drawings, like components have the same reference numerals and may not be described in detail in all drawing figures in which they appear. The illustrated embodiment is intended to illustrate, but not to limit the invention. The drawings include the following figures.

DETAILED DESCRIPTION OF THE INVENTION

A system for a wireless (i.e., radio frequency or RF) link to a remote receiving device includes a circuit board comprising communication circuitry for generating an RF signal and an antenna apparatus for transmitting and/or receiving the RF signal. The antenna apparatus includes two or more antenna elements arranged near the periphery of the circuit board. Each of the antenna elements provides a directional radiation pattern. In some embodiments, the antenna elements may be electrically selected (e.g., switched on or off) so that the antenna apparatus may form configurable radiation patterns. If multiple antenna elements are switched on, the antenna apparatus may form an omnidirectional radiation pattern.

Advantageously, the circuit board interconnects the communication circuitry and provides the antenna apparatus in one easily manufacturable printed circuit board. Including the antenna apparatus in the printed circuit board reduces the cost to manufacture the unit and simplifies interconnection with the communication circuitry. Further, including the antenna apparatus in the circuit board provides more consistent RF matching between the communication circuitry and the antenna elements. A further advantage is that the antenna apparatus radiates directional radiation patterns substantially in the plane of the antenna elements. When mounted horizontally, the radiation patterns are horizontally polarized, so that RF signal transmission indoors is enhanced as compared to a vertically polarized antenna.

Figure 1:
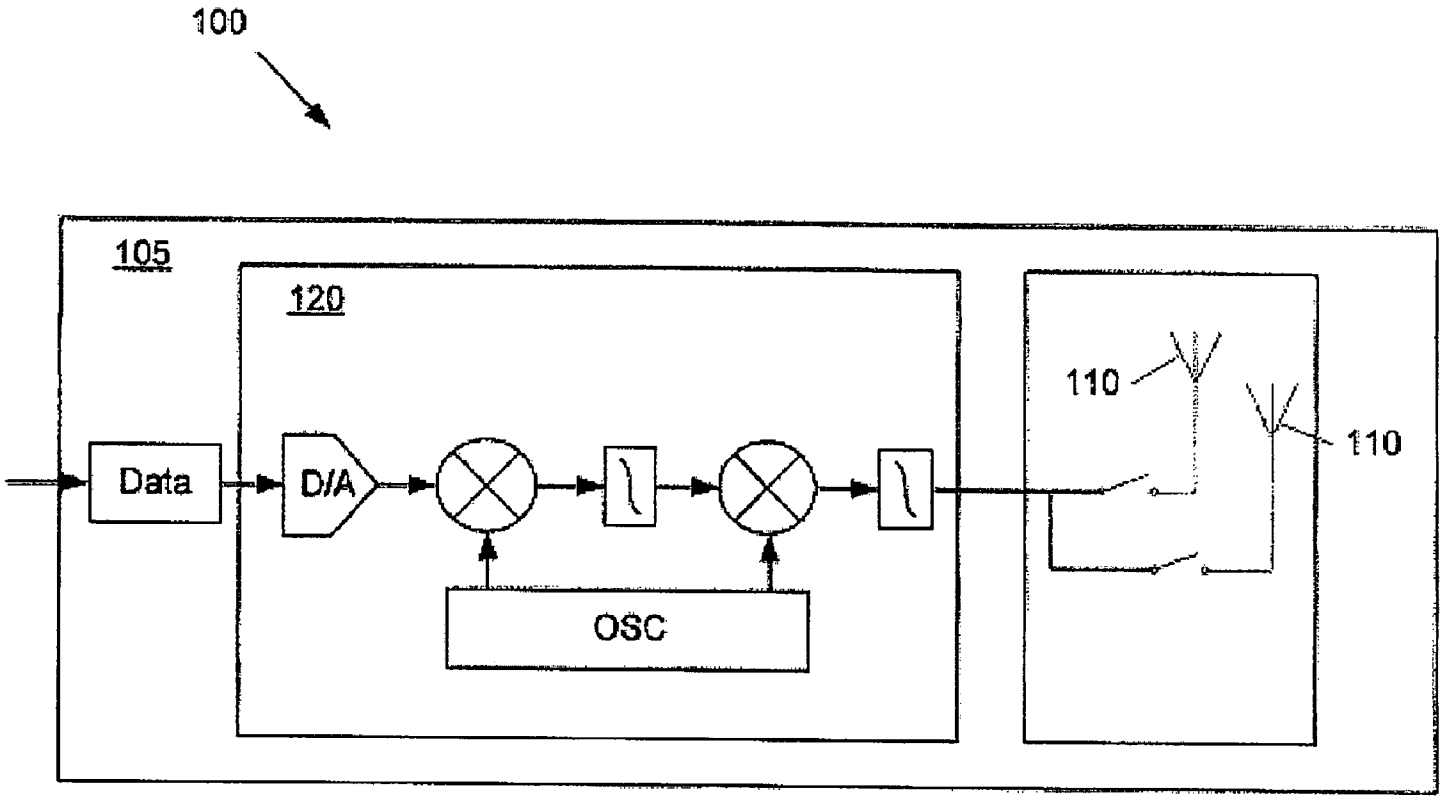
FIG. 1 illustrates an exemplary schematic for a system incorporating a circuit board having a peripheral antenna apparatus with selectable elements, in one embodiment in accordance with the present invention.

FIG. 1 illustrates an exemplary schematic for a system 100 incorporating a circuit board having a peripheral antenna apparatus with selectable elements, in one embodiment in accordance with the present invention. The system 100 may comprise, for example without limitation, a transmitter/receiver such as an 802.11 access point, an 802.11 receiver, a set-top box, a laptop computer, a television, a cellular telephone, a cordless telephone, a wireless VoIP phone, a remote control, and a remote terminal such as a handheld gaming device. In some exemplary embodiments, the system 100 comprises an access point for communicating to one or more remote receiving nodes over a wireless link, for example in an 802.11 wireless network.

The system 100 comprises a circuit board 105 including a radio modulator/demodulator (modem) 120 and a peripheral antenna apparatus 110. The modem 120 may include a digital to analog converter (D/A), an oscillator (OSC), mixers (X), and other signal processing circuitry (reverse-∫). The radio modem 120 may receive data from a router connected to the Internet (not shown), convert the data into a modulated RF signal, and the antenna apparatus 110 may transmit the modulated RF signal wirelessly to one or more remote receiving nodes (not shown). The system 100 may also form a part of a wireless local area network by enabling communications among several remote receiving nodes. Although the disclosure will focus on a specific embodiment for the system 100 including the circuit board 105, aspects of the invention are applicable to a wide variety of appliances, and are not intended to be limited to the disclosed embodiment. For example, although the system 100 may be described as transmitting to a remote receiving node via the antenna apparatus 110, the system 100 may also receive RF-modulated data from the remote receiving node via the antenna apparatus 110.

Figure 2:
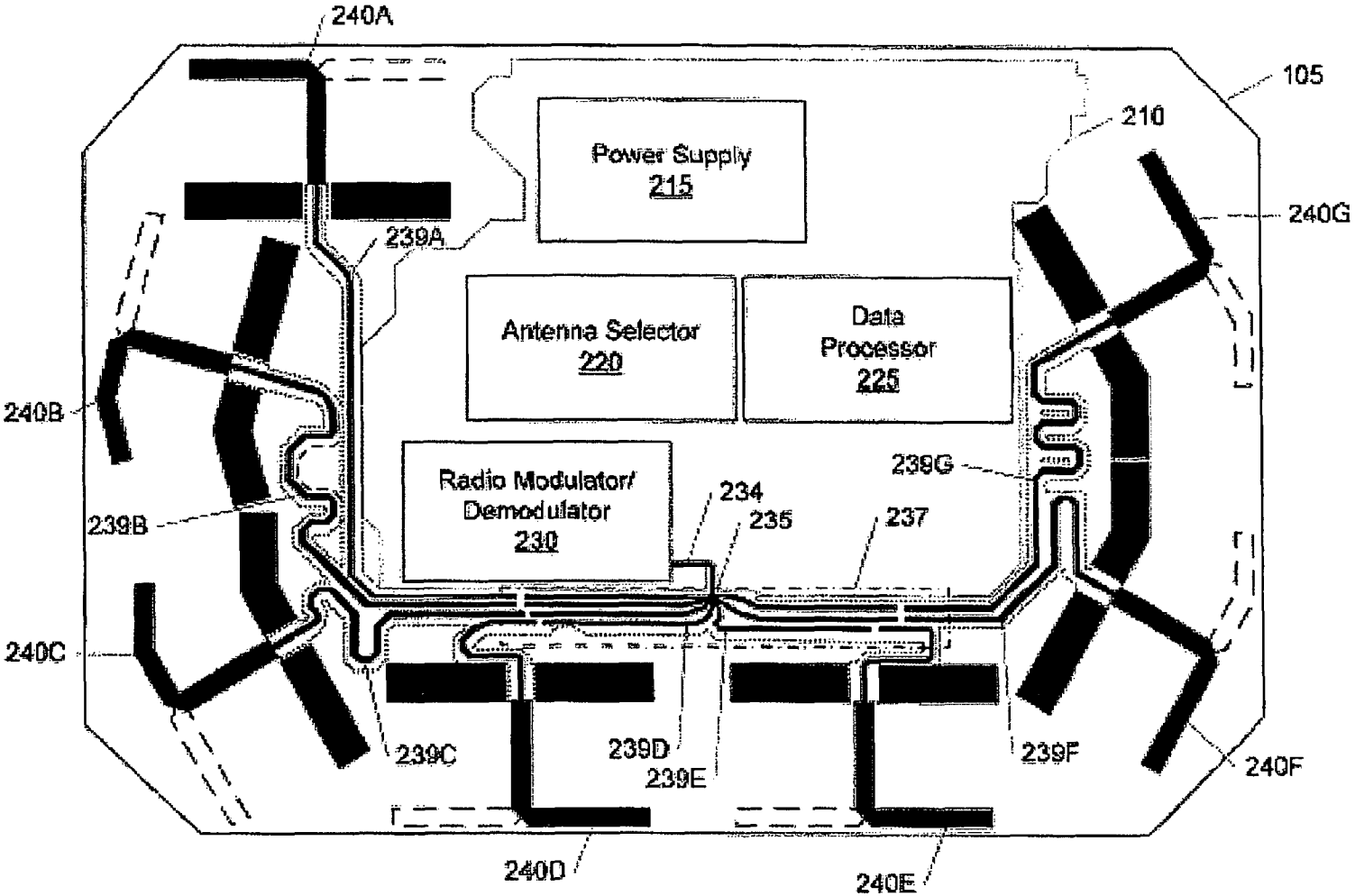
FIG. 2 illustrates the circuit board having the peripheral antenna apparatus with selectable elements of FIG. 1, in one embodiment in accordance with the present invention.

FIG. 2 illustrates the circuit board 105 having the peripheral antenna apparatus 110 of FIG. 1 with selectable elements of FIG. 1, in one embodiment in accordance with the present invention. In some embodiments, the circuit board 105 comprises a printed circuit board (PCB) such as FR4 material, Rogers 4003 material, or other dielectric material with four layers, although any number of layers is comprehended, such as one or six.

The circuit board 105 includes an area 210 for interconnecting circuitry including for example a power supply 215, an antenna selector 220, a data processor 225, and a radio modulator/demodulator (modem) 230. In some embodiments, the data processor 225 comprises well-known circuitry for receiving data packets from a router connected to the Internet (e.g., via a local area network). The radio modem 230 comprises communication circuitry including virtually any device for converting the data packets processed by the data processor 225 into a modulated RF signal for transmission to one or more of the remote receiving nodes, and for reception therefrom. In some embodiments, the radio modem 230 comprises circuitry for converting the data packets into an 802.11 compliant modulated RF signal.

From the radio modem 230, the circuit board 105 also includes a microstrip RF line 234 for routing the modulated RF signal to an antenna feed port 235. Although not shown, in some embodiments, an antenna feed port 235 is configured to distribute the modulated RF signal directly to antenna elements 240A, 240B, 240C, 240D, 240E, 240F, 240G of the peripheral antenna apparatus 110 (not labeled) by way of antenna feed lines. In the embodiment depicted in FIG. 2, the antenna feed port 235 is configured to distribute the modulated RF signal to one or more of the selectable antenna elements 240A-240G by way of a switching network 237 and microstrip feed lines 239A, 239B, 239C, 239D, 239E, 239F, 239G. Although described as microstrip, the feed lines 239A-239G may also comprise coupled microstrip, coplanar strips with impedance transformers, coplanar waveguide, coupled strips, and the like.

The antenna feed port 235, the switching network 237, and the feed lines 239A-239G comprise switching and routing components on the circuit board 105 for routing the modulated RF signal to the antenna elements 240A-240G. As described further herein, the antenna feed port 235, the switching network 237, and the feed lines 239A-239G include structures for impedance matching between the radio modem 230 and the antenna elements 240A-240G. The antenna feed port 235, the switching network 237, and the feed lines 239A-239G are further described with respect to FIG. 5.

As described further herein, the peripheral antenna apparatus comprises a plurality of antenna elements 240A-240G located near peripheral areas of the circuit board 105. Each of the antenna elements 240A-240G produces a directional radiation pattern with gain (as compared to an omnidirectional antenna) and with polarization substantially in the plane of the circuit board 105. Each of the antenna elements may be arranged in an offset direction from the other antenna elements 240A-240G so that the directional radiation pattern produced by one antenna element (e.g., the antenna element 240A) is offset in direction from the directional radiation pattern produced by another antenna element (e.g., the antenna element 240C). Certain antenna elements may also be arranged in substantially the same direction, such as the antenna elements 240D and 240E. Arranging two or more of the antenna elements 240A-240G in the same direction provides spatial diversity between the antenna elements 240A-240G so arranged.

In embodiments with the switching network 237, selecting various combinations of the antenna elements 240A-240G produces various radiation patterns ranging from highly directional to omnidirectional. Generally, enabling adjacent antenna elements 240A-240G results in higher directionality in azimuth as compared to selecting either of the antenna elements 240A-240G alone. For example, selecting the adjacent antenna elements 240A and 240B may provide higher directionality than selecting either of the antenna elements 240A or 240B alone. Alternatively, selecting every other antenna element (e.g., the antenna elements 240A, 240C, 240E, and 240G) or all of the antenna elements 240A-240G may produce an omnidirectional radiation pattern.

The operating principle of the selectable antenna elements 240A-240G may be further understood by review of U.S. patent application Ser. No. 11/010,076, titled "System and Method for an Omnidirectional Planar Antenna Apparatus with Selectable Elements," filed Dec 9, 2004, now U.S. Pat. No. 7,292,198, incorporated by reference herein.

Figure 3A:
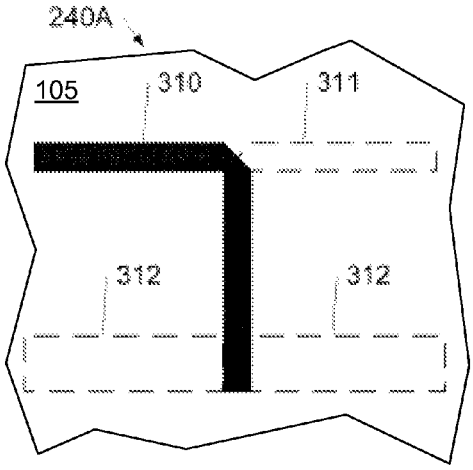
FIG. 3A illustrates a modified dipole for the antenna apparatus of FIG. 2, in one embodiment in accordance with the present invention.

FIG. 3A illustrates the antenna element 240A of FIG. 2, in one embodiment in accordance with the present invention. The antenna element 240A of this embodiment comprises a modified dipole with components on both exterior surfaces of the circuit board 105 (considered as the plane of FIG. 3A). Specifically, on a first surface of the circuit board 105, the antenna element 240A includes a first dipole component 310. On a second surface of the circuit board 105, depicted by dashed lines in FIG. 3, the antenna element 240A includes a second dipole component 311 extending substantially opposite from the first dipole component 310. The first dipole component 310 and the second dipole component 311 form the antenna element 240A to produce a generally cardioid directional radiation pattern substantially in the plane of the circuit board.

In some embodiments, such as the antenna elements 240B and 240C of FIG. 2, the dipole component 310 and/or the dipole component 311 may be bent to conform to an edge of the circuit board 105. Incorporating the bend in the dipole component 310 and/or the dipole component 311 may reduce the size of the circuit board 105. Although described as being formed on the surface of the circuit board 105, in some embodiments the dipole components 310 and 311 are formed on interior layers of the circuit board, as described herein.

The antenna element 240A may optionally include one or more reflectors (e.g., the reflector 312). The reflector 312 comprises elements that may be configured to concentrate the directional radiation pattern formed by the first dipole component 310 and the second dipole component 311. The reflector 312 may also be configured to broaden the frequency response of the antenna component 240A. In some embodiments, the reflector 312 broadens the frequency response of each modified dipole to about 300 MHz to 500 MHz. In some embodiments, the combined operational bandwidth of the antenna apparatus resulting from coupling more than one of the antenna elements 240A-240G to the antenna feed port 235 is less than the bandwidth resulting from coupling only one of the antenna elements 240A-240G to the antenna feed port 235. For example, with four antenna elements 240A-240G (e.g., the antenna elements 240A, 240C, 240E, and 240G) selected to result in an omnidirectional radiation pattern, the combined frequency response of the antenna apparatus is about 90 MHz. In some embodiments, coupling more than one of the antenna elements 240A-240G to the antenna feed port 235 maintains a match with less than 10 dB return loss over 802.11 wireless LAN frequencies, regardless of the number of antenna elements 240A-240G that are switched on.

Figure 3B:
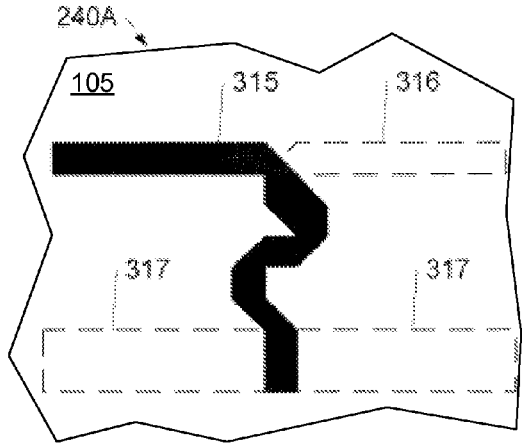
FIG. 3B illustrates a size reduced modified dipole for the antenna apparatus of FIG. 2, in an alternative embodiment in accordance with the present invention.

FIG. 3B illustrates the antenna element 240A of FIG. 2, in an alternative embodiment in accordance with the present invention. The antenna element 240A of this embodiment may be reduced in dimension as compared to the antenna element 240A of FIG. 3A. Specifically, the antenna element 240A of this embodiment comprises a first dipole component 315 incorporating a meander line shape, a second dipole component 316 incorporating a corresponding meander line shape, and a reflector 317. Because of the meander line shape, the antenna element 240A of this embodiment may require less space on the circuit board 105 as compared to the antenna element 240A of FIG. 3A.

Figure 3C:
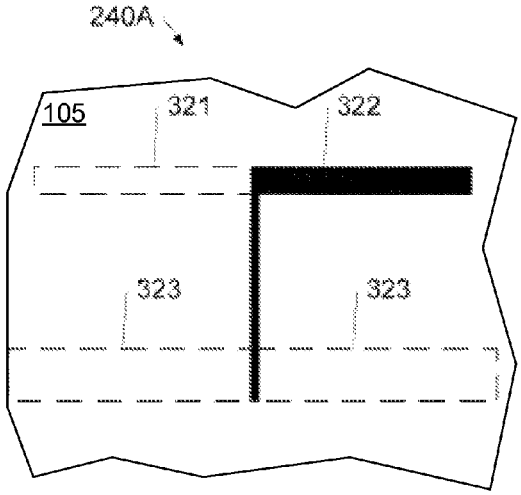
FIG. 3C illustrates an alternative modified dipole for the antenna apparatus of FIG. 2, in an alternative embodiment in accordance with the present invention.

FIG. 3C illustrates the antenna element 240A of FIG. 2, in an alternative embodiment in accordance with the present invention. The antenna element 240A of this embodiment includes one or more components on one or more layers internal to the circuit board 105. Specifically, in one embodiment, a first dipole component 321 is formed on an internal ground plane of the circuit board 105. A second dipole component 322 is formed on an exterior surface of the circuit board 105. As described further with respect to FIG. 4, a reflector 323 may be formed internal to the circuit board 105, or may be formed on the exterior surface of the circuit board 105. An advantage of this embodiment of the antenna element 240A is that vias through the circuit board 105 may be reduced or eliminated, making the antenna element 240A of this embodiment less expensive to manufacture.

Figure 3D:
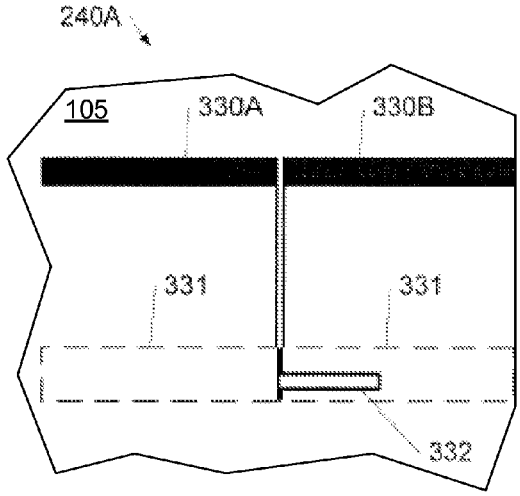
FIG. 3D illustrates a modified dipole with coplanar strip transition for the antenna apparatus of FIG. 2, in an alternative embodiment in accordance with the present invention.

FIG. 3D illustrates the antenna element 240A of FIG. 2, in an alternative embodiment in accordance with the present invention. The antenna element 240A of this embodiment includes a modified dipole with a microstrip to coplanar strip (CPS) transition 332 and CPS dipole arms 330A and 330B on a surface layer of the circuit board 105. Specifically, this embodiment provides that the CPS dipole arm 330A may be coplanar with the CPS dipole arm 330B, and may be formed on the same surface of the circuit board 105. This embodiment may also include a reflector 331 formed on one or more interior layers of the circuit board 105 or on the opposite surface of the circuit board 105. An advantage of this embodiment is that no vias are needed in the circuit board 105.

It will be appreciated that the dimensions of the individual components of the antenna elements 240A-240G (e.g., the first dipole component 310, the second dipole component 311, and the reflector 312) depend upon a desired operating frequency of the antenna apparatus. Furthermore, it will be appreciated that the dimensions of wavelength depend upon conductive and dielectric materials comprising the circuit board 105, because speed of electron propagation depends upon the properties of the circuit board 105 material. Therefore, dimensions of wavelength referred to herein are intended specifically to incorporate properties of the circuit board, including considerations such as the conductive and dielectric properties of the circuit board 105. The dimensions of the individual components may be established by use of RF simulation software, such as IE3D from Zeland Software of Fremont, Calif.

Figure 4:
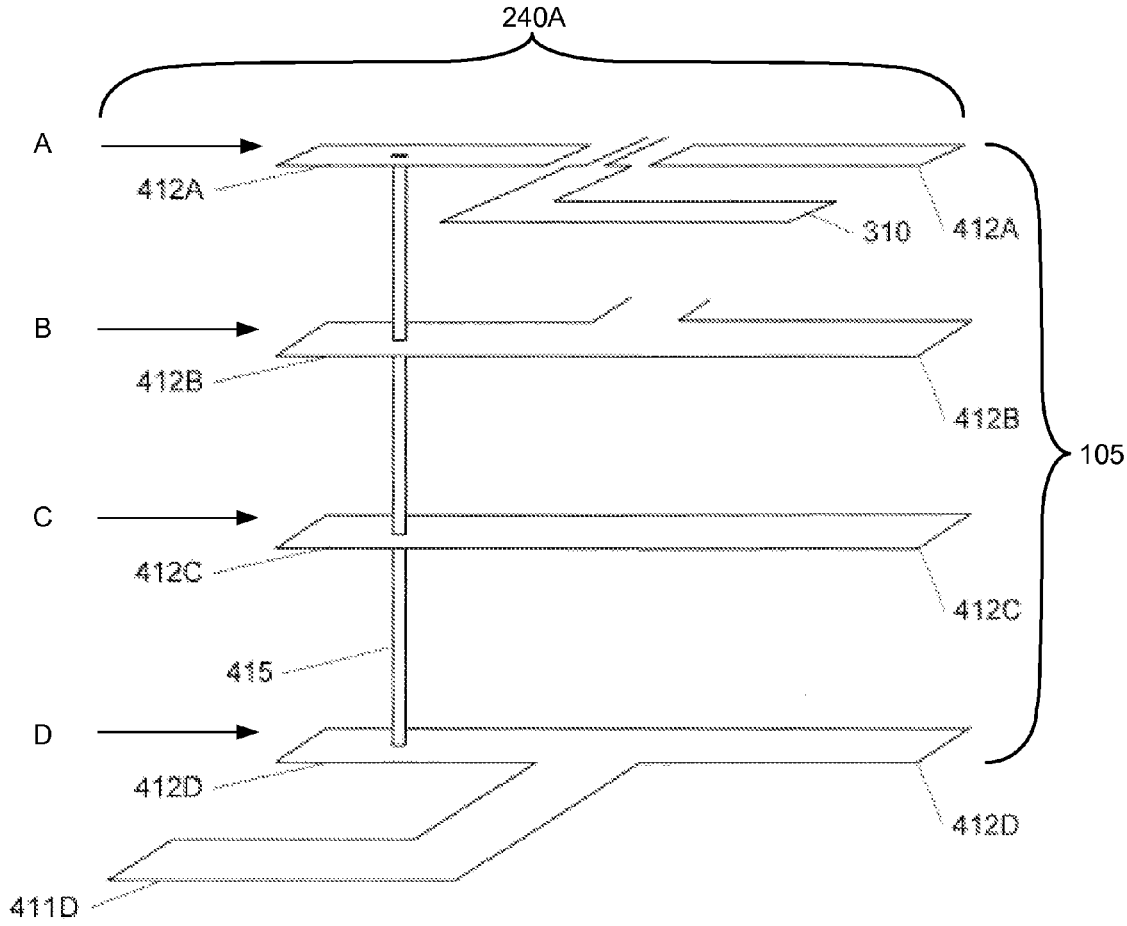
FIG. 4 illustrates the antenna element of FIG. 3A, showing multiple layers of the circuit board, in one embodiment of the invention.

FIG. 4 illustrates the antenna element 240A of FIG. 3A, showing multiple layers of the circuit board 105, in one embodiment of the invention. The circuit board 105 of this embodiment comprises a 60 mil thick stackup with three dielectrics and four metallization layers A-D, with an internal RF ground plane at layer B (10 mils from top layer A to the internal ground layer B). Layer B is separated by a 40 mil thick dielectric to the next layer C, which may comprise a power plane. Layer C is separated by a 10 mil dielectric to the bottom layer D.

The first dipole component 310 and portions 412A of the reflector 312 is formed on the first (exterior) surface layer A. In the second metallization layer B, which includes a connection to the ground layer (depicted as an open trace), corresponding portions 412B of the reflector 312 are formed. On the third metallization layer C, corresponding portions 412C of the reflector 312 are formed. The second dipole component 411D is formed along with corresponding portions of the reflector 412D on the fourth (exterior) surface metallization layer D. The reflectors 412A-412D and the second dipole component 411B-411D on the different layers are interconnected to the ground layer B by an array of metalized vias 415 (only one via 415 shown, for clarity) spaced less than 1/20th of a wavelength apart, as determined by an operating RF frequency range of 2.4-2.5 GHz for an 802.11 configuration. It will be apparent to a person or ordinary skill that the reflector 312 comprises four layers, depicted as 412A-412D.

An advantage of the antenna element 240A of FIG. 4 is that transitions in the RF path are avoided. Further, because of the cutaway portion of the reflector 412A and the array of vias interconnecting the layers of the circuit board 105, the antenna element 240A of this embodiment offers a good ground plane for the ground dipole 311 and the reflector element 312.

Figure 5A:
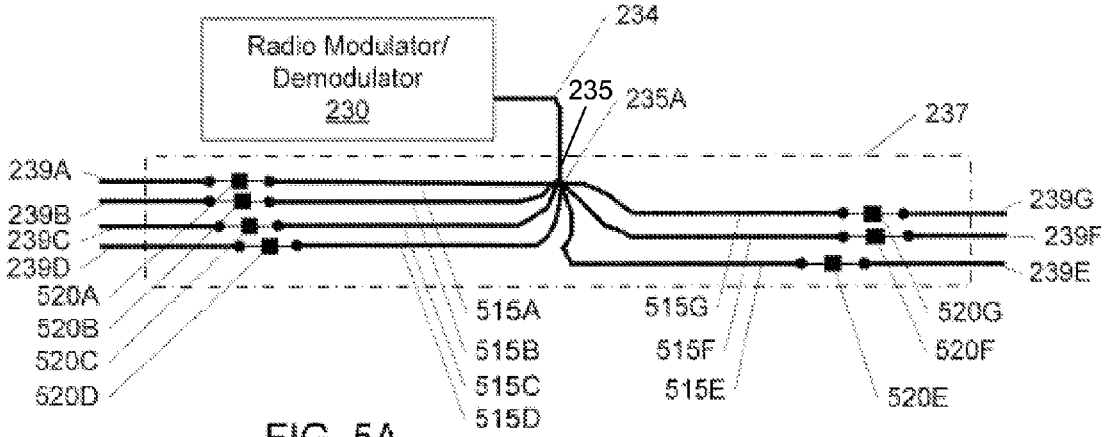
FIG. 5A illustrates the antenna feed port and the switching network of FIG. 2, in one embodiment in accordance with the present invention.

FIG. 5A illustrates the antenna feed port 235 and the switching network 237 of FIG. 2, in one embodiment in accordance with the present invention. The antenna feed port 235 of this embodiment receives the RF line 234 from the radio modem 230 into a distribution point 235A. From the distribution point 235A, impedance matched RF traces 515A, 515B, 515C, 515D, 515E, 515F, 515G extend to PIN diodes 520A, 520B, 520C, 520D, 520E, 520F, 520G. In one embodiment, the RF traces 515A-515G comprise 20 mils wide traces, based upon a 10 mil dielectric from the internal ground layer (e.g., the ground layer B of FIG. 4). Feed lines 239A-239G (only portions of the feed lines 239A-239G are shown for clarity) extend from the PIN diodes 520A-520G to each of the antenna elements 240A-240G.

Each PIN diode comprises a single-pole single-throw switch to switch each antenna element either on or off (i.e., couple or decouple each of the antenna elements 240A-240G to the antenna feed port 235). In one embodiment, a series of control signals (not shown) is used to bias each PIN diode. With the PIN diode forward biased and conducting a DC current, the PIN diode is switched on, and the corresponding antenna element is selected. With the PIN diode reverse biased, the PIN diode is switched off.

In one embodiment, the RF traces 515A-515G are of length equal to a multiple of one half wavelength from the antenna feed port 235. Although depicted as equal length in FIG. 5A, the RF traces 515A-515G may be unequal in length, but multiples of one half wavelength from the antenna feed port 235. For example, the RF trace 515A may be of zero length so that the PIN diode 520A is directly attached to the antenna feed port 235. The RF trace 515B may be one half wavelength, the RF trace 515C may be one wavelength, and so on, in any combination. The PIN diodes 520A-520G are multiples of one half wavelength from the antenna feed port 235 so that disabling one PIN diode (e.g. the PIN diode 520A) does not create an RF mismatch that would cause RF reflections back to the distribution point 235A and to other traces that are enabled (e.g., the trace 515B). In this fashion, when the PIN diode 540A is "off," the radio modem 230 sees a high impedance on the trace 515A, and the impedance of the trace 515B that is "on" is virtually unaffected by the PIN diode 520A. In some embodiments, the PIN diodes 520A-520G are located at an offset from the one half wavelength distance. The offset is determined to account for stray capacitance in the distribution point 235A and/or the PIN diodes 520A-520G.

Figure 5B:
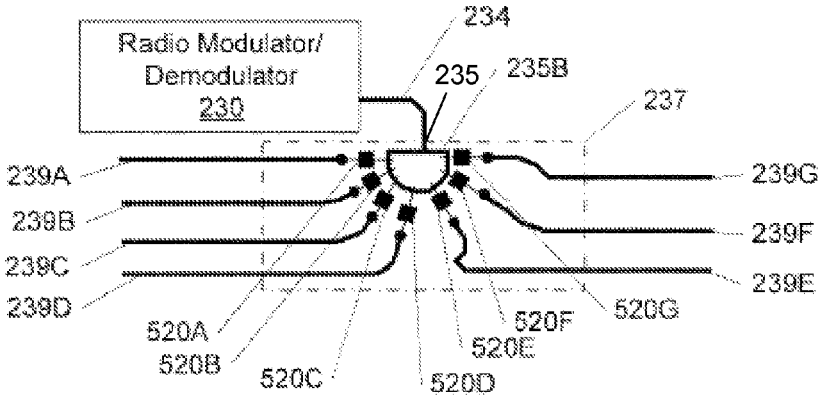
FIG. 5B illustrates the antenna feed port and the switching network of FIG. 2, in an alternative embodiment in accordance with the present invention.

FIG. 5B illustrates the antenna feed port 235 and the switching network 237 of FIG. 2, in an alternative embodiment in accordance with the present invention. The antenna feed port 235 of this embodiment receives the RF line 234 from the radio modem 230 into a distribution point 235B. The distribution point 235B of this embodiment is configured as a solder pad for the PIN diodes 520A-520G. The PIN diodes 520A-520G are soldered between the distribution point 235B and the ends of the feed lines 239A-239G. In essence, the distribution point 235B of this embodiment acts as a zero wavelength distance from the antenna feed port 235. An advantage of this embodiment is that the feed lines extending from the PIN diodes 520A-520G to the antenna elements 240A-240G offer unbroken controlled impedance.

Figure 5C:
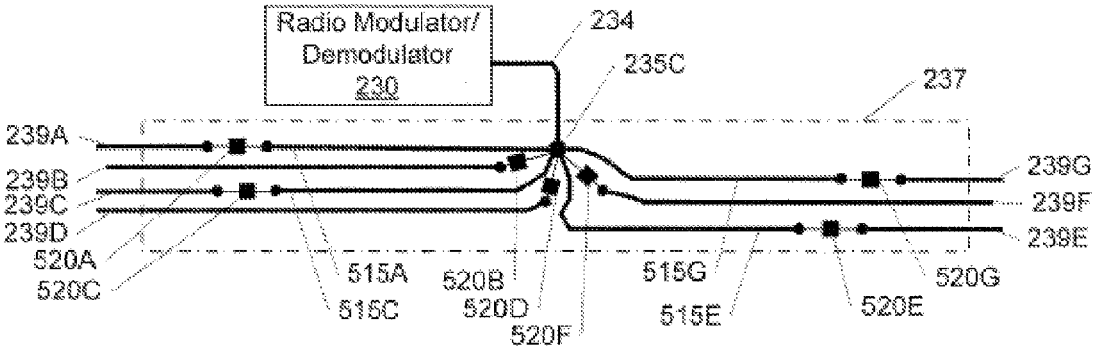
FIG. 5C illustrates the antenna feed port and the switching network of FIG. 2, in an alternative embodiment in accordance with the present invention.

FIG. 5C illustrates the antenna feed port and the switching network of FIG. 2, in an alternative embodiment in accordance with the present invention. This embodiment may be considered as a combination of the embodiments depicted in FIGS. 5A and 5B. The PIN diodes 520A, 520C, 520E, and 520G are connected to the RF traces 515A, 515C, 515E, and 515G, respectively, in similar fashion to that described with respect to FIG. 5A. However, the PIN diodes 520B, 520D, and 520F are soldered to a distribution point 235C and to the corresponding feed lines 239B, 239D, and 239F, in similar fashion to that described with respect to FIG. 5B.

Although the switching network 237 is described as comprising PIN diodes 520, it will be appreciated that the switching network 237 may comprise virtually any RF switching device such as a GaAs FET, as is well known in the art. In some embodiments, the switching network 237 comprises one or more single-pole multiple-throw switches. In some embodiments, one or more light emitting diodes (not shown) are coupled to the switching network 237 or the feed lines 239A-239G as a visual indicator of which of the antenna elements 240A-240G is on or off. In one embodiment, a light emitting diode is placed in circuit with each PIN diode 520 so that the light emitting diode is lit when the corresponding antenna element is selected.

Referring to FIG. 2, because in some embodiments the antenna feed port 235 is not in the center of the circuit board 105, which would make the antenna feed lines 239A-239G of equal length and minimum loss, the lengths of the antenna feed lines 239A-239G may not comprise equivalent lengths from the antenna feed port 235. Unequal lengths of the antenna feed lines 239A-239G may result in phase offsets between the antenna elements 240A-240G. Accordingly, in some embodiments not shown in FIG. 2, each of the feed lines 239A-239G to the antenna elements 240A-240G are designed to be as long as the longest of the feed lines 239A-239G, even for antenna elements 240A-240G that are relatively close to the antenna feed port 235. In some embodiments, the lengths of the feed lines 239A-239G are designed to be a multiple of a half-wavelength offset from the longest of the feed lines 239A-239G. In still other embodiments, the lengths of the feed lines 239A-239G that are odd multiples of one half wavelength from the other feed lines 239A-239G incorporate a "phase-inverted" antenna element to compensate for having lengths that are odd multiples of one half wavelength from the other feed lines 239A-239G. For example, referring to FIG. 2, the antenna elements 240C and 240F are inverted by 180 degrees because the feed lines 239C and 239F are 180 degrees out of phase from the feed lines 239A, 239B, 239D, 239E, and 239G. In an antenna element that is phase inverted, the first dipole component (e.g., surface layer) replaces the second dipole component (e.g., ground layer). It will be appreciated that this provides the 180 degree phase shift in the antenna element to compensate for the 180 degree feed line phase shift.

An advantage of the system 100 (FIG. 1) incorporating the circuit board 105 having the peripheral antenna apparatus with selectable antenna elements 240A-240G (FIG. 2) is that the antenna elements 240A-240G are constructed directly on the circuit board 105, therefore the entire circuit board 105 can be easily manufactured at low cost. As depicted in FIG. 2, one embodiment or layout of the circuit board 105 comprises a substantially square or rectangular shape, so that the circuit board 105 is easily panelized from readily available circuit board material. As compared to a system incorporating externally-mounted vertically polarized "whip" antennas for diversity, the circuit board 105 minimizes or eliminates the possibility of damage to the antenna elements 240A-240G.

A further advantage of the circuit board 105 incorporating the peripheral antenna apparatus with selectable antenna elements 240A-240G is that the antenna elements 240A-240G may be configured to reduce interference in the wireless link between the system 100 and a remote receiving node. For example, the system 100 communicating over the wireless link to the remote receiving node may select a particular configuration of selected antenna elements 240A-240G that minimizes interference over the wireless link. For example, if an interfering signal is received strongly via the antenna element 240C, and the remote receiving node is received strongly via the antenna element 240A, selecting only the antenna element 240A may reduce the interfering signal as opposed to selecting the antenna element 240C. The system 100 may select a configuration of selected antenna elements 240A-240G corresponding to a maximum gain between the system and the remote receiving node. Alternatively, the system 100 may select a configuration of selected antenna elements 240A-240G corresponding to less than maximal gain, but corresponding to reduced interference. Alternatively, the antenna elements 240A-240G may be selected to form a combined omnidirectional radiation pattern.

Another advantage of the circuit board 105 is that the directional radiation pattern of the antenna elements 240A-240G is substantially in the plane of the circuit board 105. When the circuit board 105 is mounted horizontally, the corresponding radiation patterns of the antenna elements 240A-240G are horizontally polarized. Horizontally polarized RF energy tends to propagate better indoors than vertically polarized RF energy. Providing horizontally polarized signals improves interference rejection (potentially, up to 20 dB) from RF sources that use commonly-available vertically polarized antennas.

Selectable Phase Shifting

In some embodiments, selectable phase switching can be included on the circuit board 105 to provide a number of advantages. For example, incorporating selectable phase switching into the circuit board 105 may allow a reduction in the number of antenna elements 240A-240G used on the circuit board 105 while still providing highly configurable radiation patterns. By selecting two or more of the antenna elements 240A-240G and by shifting one or more of the antenna elements 240A-240G by 180 degrees, for example, the resulting radiation pattern may overlap a radiation pattern of another of the antenna elements 240A-240G, rendering some of the antenna elements 240A-240G redundant, or rendering unnecessary the addition of some antenna elements at particular orientations. Therefore, incorporating selectable phase shifting into the circuit board 105 may allow a reduction in the number of antenna elements 240A-240G and a reduction in the overall size of the circuit board 105. Because the cost of the circuit board 105 is dependent upon the amount of area of the PCB included in the circuit board 105, selectable phase shifting allows cost reduction in that fewer antenna elements 240A-240G may be used for a given number of radiation patterns.

The remainder of the disclosure concerns selectable phase shifting in the context of configurable antenna elements 240A-240G as described with respect to the circuit board 105. However, it will be readily apparent that selectable phase shifting has broad applicablity in RF coupling networks and is not limited merely to embodiments for antenna coupling. For example, selectable phase shifting as described further herein has applicability to signal cancellation such as is generally used in band-stop or notch filters.

Figure 6:
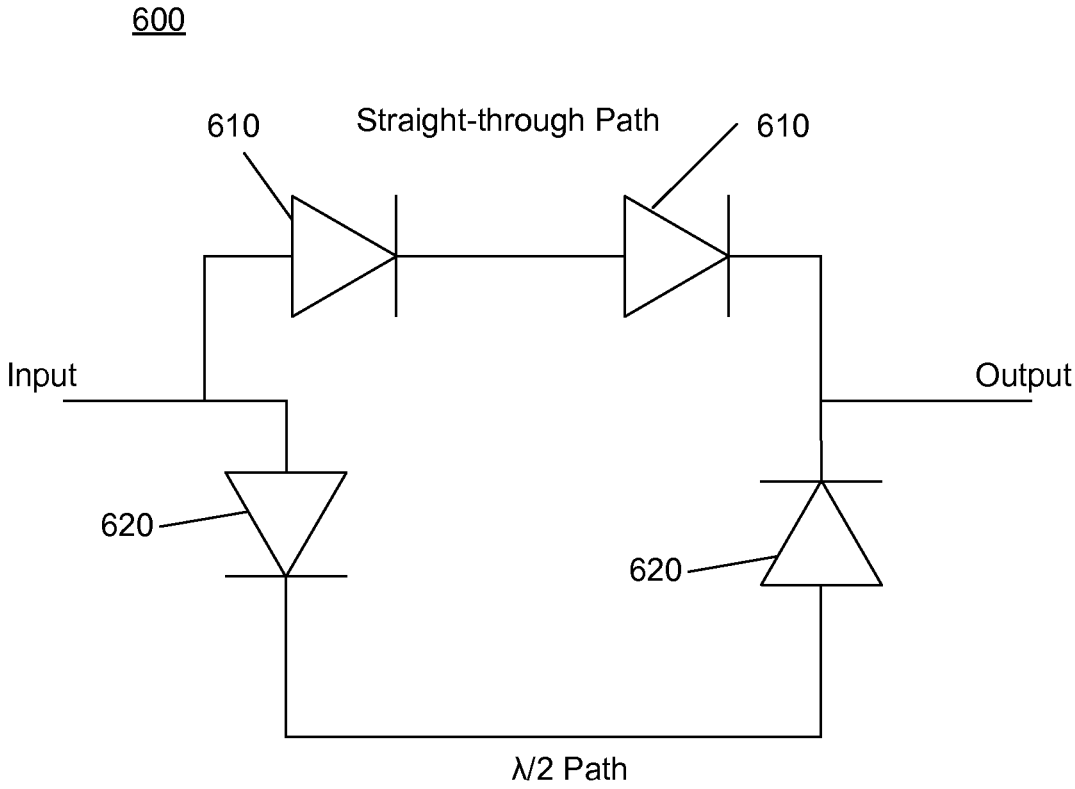
FIG. 6 (PRIOR ART)
FIG. 6 illustrates a 180 degree phase shifter in the prior art.

FIG. 6 illustrates a 180 degree phase shifter 600 in the prior art. When forward biased ("biased on"), two PIN diodes 610 allow RF to travel through a straight-through path from an input port to an output port. Alternatively, when biased on, two PIN diodes 620 allow RF to travel through a 180 degree phase shift (λ/2 or ½-wavelength) path from the input port to the output port.

Figure 7:
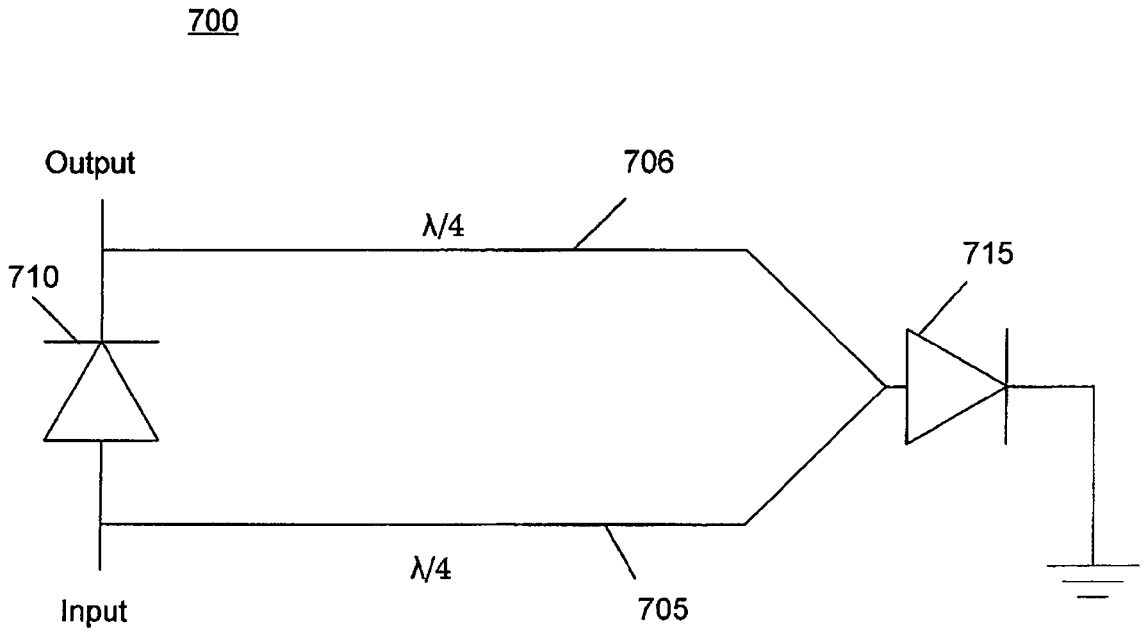
FIG. 7 illustrates a block diagram of a 180 degree phase shifter, in one embodiment in accordance with the present invention.

FIG. 7 illustrates a block diagram of a 180 degree phase shifter 700, in one embodiment in accordance with the present invention. The phase shifter 700 may be included in the various embodiments of the switching network 237 depicted in FIGS. 5A, 5B, and 5C, for example, to implement selectable phase shifting for one or more of the antenna elements 240A-240G of FIG. 2.

In FIG. 7, the phase shifter 700 includes a first PIN diode 710 along a straight-though path between the input port and the output port, a first PCB trace line 705 of ¼-wavelength (i.e,. λ/4) of phase delay, a second PCB trace line 706 of ¼-wavelength (i.e., λ/4) of phase delay, and a second PIN diode 715 at the confluence of the first trace line 705 and the second trace line 706. For ease of explanation, the phase shifter 700 takes advantage of the property of ¼-wavelength transmission lines that a short to ground, a quarter-wavelength away from the opposite end of the ¼-wavelength transmission line, is an open. Therefore, when the second PIN diode 715 is biased on, essentially shorting the confluence of the first trace line 705 and the second trace line 706 to ground, the trace lines 705 and 706 appear as high impedance at the input port and the output port. With the first PIN diode 710 biased on and the second PIN diode 715 biased on, therefore, the input is directly connected to the output through the PIN diode 710. The ¼-wavelength trace lines 705 and 706 present a negligible impact on the RF at the input or output ports because a short to ground at the second PIN diode 715, a quarter-wavelength away at the input and output ports, is an open.

Alternatively, with the first PIN diode 710 zero biased or reverse biased ("biased off") and the second PIN diode 715 biased off, an RF signal at the input port is directed through the two ¼-wavelength trace lines 705 and 706 and is thereby shifted in phase by 180 degrees at the output port.

Therefore, as compared to a prior art phase shifter 600 that requires four PIN diodes, therefore, selecting between a straight-through path or a 180 degree phase shifted path requires only two PIN diodes 710 and 715. In other examples, one or more RF switches may replace the PIN diodes.

Continuing the truth table, with the first PIN diode 710 biased off and the second PIN diode 715 biased on, the input port "sees" high impedance to the output port due to the first PIN diode 710 and also sees high impedance due to the ¼-wavelength trace lines 705 and 706. Therefore, the output port is isolated from the input port. For an antenna element coupled to the output port, for example, the antenna element would be off with the first PIN diode 710 biased off and the second PIN diode 715 biased on.

A special case occurs with the first PIN diode 710 biased on and the second PIN diode 715 biased off. In this case, RF at the input port sees a low impedance coupling to the output port through the first PIN diode 710. However, the RF also transmits through the ¼-wavelength trace lines 705 and 706. The in-phase RF through the straight-through path is coupled to 180 degree phase shifted RF, and essentially the phase shifter 700 performs as a band-stop filter or a notch filter tuned to the wavelength (inverse of frequency) of the ¼-wavelength trace lines 705 and 706.

In other embodiments, the first PCB trace line is a multiple of ¼ wavelength of phase delay and the second PCB trace line is also a multiple of ¼ wavelength of phase delay. In one example, the first PCB trace line is ¾ wavelength of phase delay and the second PCB trace line is also ¾ wavelength of phase delay. In this example, when the first PIN diode 710 is biased off and the second PIN diode 715 biased off, an RF signal at the input port is directed through the ¾-wavelength trace lines 705 and 706 and is thereby shifted in phase by 540 (i.e. 180) degrees at the output port. In yet another example, the first PCB trace line is ½ wavelength of phase delay and the second PCB trace line is also ½ wavelength of phase delay. In this example, when the first PIN diode 710 is biased off and the second PIN diode 715 biased off, an RF signal is shifted in phase by 360 degrees at the output port.

Figure 8:
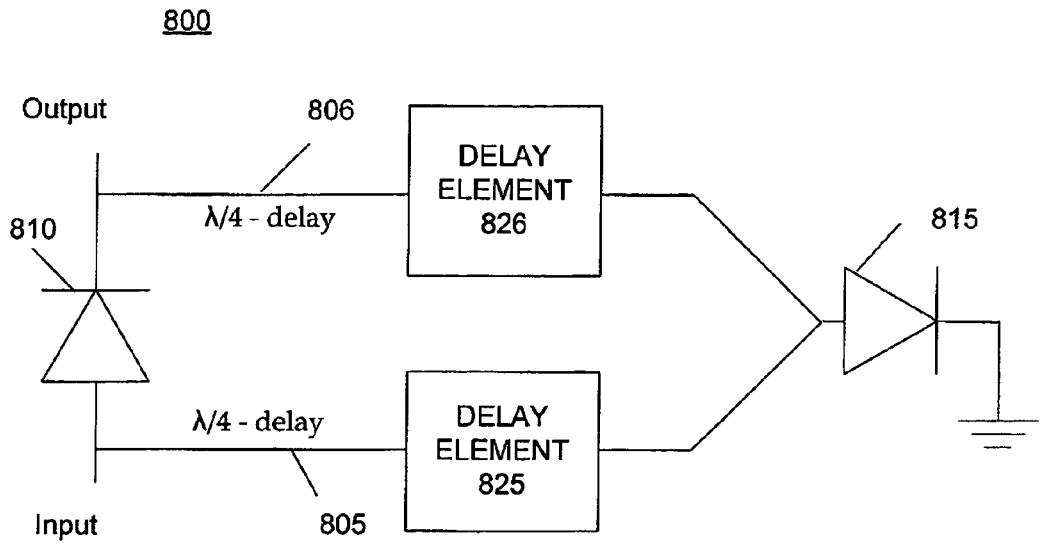
FIG. 8 illustrates a 180 degree phase shifter including delay elements, in one alternative embodiment in accordance with the present invention.

FIG. 8 illustrates a 180 degree phase shifter 800 including delay elements, in one alternative embodiment in accordance with the present invention. As with the phase shifter 700 of FIG. 7, the phase shifter 800 includes a first PIN diode 810 along a straight-though path between the input port and the output port, and a second PIN diode 815 at the confluence of ¼-wavelength delay paths.

As compared to the embodiment of FIG. 7, delay elements 825 and 826 are provided so that the trace lines 805 and 806 may be made physically shorter than the corresponding trace lines 705 and 706. The delay elements 825 and 826 comprise delay lines in one embodiment. In another embodiment, the delay elements 825 and 826 comprise all-pass filters, similar in function to delay lines, to provide a predetermined phase shift or group delay. Persons of ordinary skill will recognize that there are many possible embodiments for the delay elements 825 and 826. Generally, the delay elements 825 and 826 comprise well-known resistors, capacitors (fixed or voltage controlled), inductors, and the like, configured to provide a predetermined phase shift or group delay.

A first PCB trace line 805 is of length ¼-wavelength (i.e., λ/4) of phase delay less the amount of delay presented by the delay element 825 (λ/4-delay). Similarly, a second PCB trace line 806 is of length ¼-wavelength (i.e., λ/4) of phase delay less the amount of delay presented by the delay element 826 (λ/4-delay).

As described above with respect to FIG. 7, by biasing the PIN diodes 810 and 815 variously on or off, the phase shifter 800 can provide a straight-through path between the input port and the output port, a 180 degree phase shift, a high impedance between the input port and the output port, or a notch or band-stop filter.

Figure 9:
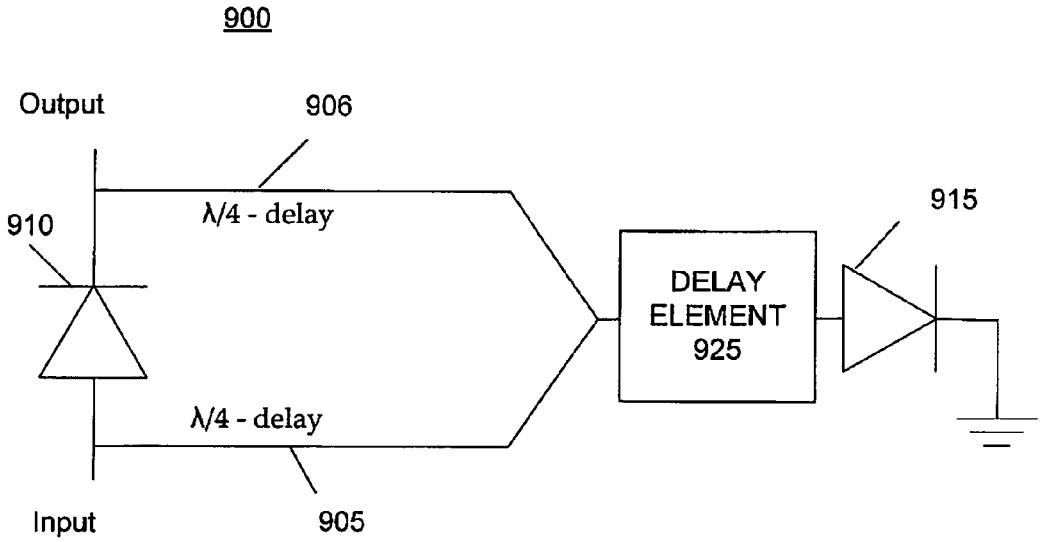
FIG. 9 illustrates a 180 degree phase shifter including a single delay element, in one alternative embodiment in accordance with the present invention.

FIG. 9 illustrates a 180 degree phase shifter 900 including a single delay element, in one alternative embodiment in accordance with the present invention. The phase shifter 900 includes a first PIN diode 910 along a straight-though path between the input port and the output port. A single delay element 925 is provided so that trace lines 905 and 906 may be made physically shorter than the corresponding trace lines 705 and 706 of FIG. 7. The delay element 925 comprises a delay line, an all-pass filter, or the like to provide a predetermined phase shift or group delay. A second PIN diode 915 completes the phase shifter 900 by selectively coupling the delay element 925 to ground.

In similar fashion to the embodiment of FIG. 8, a first PCB trace line 905 is of length ¼-wavelength (i.e., λ/4) of phase delay less the amount of delay presented by the delay element 925 (λ/4-delay). Similarly, a second PCB trace line 906 is of length ¼-wavelength (i.e., λ/4) of phase delay less the amount of delay presented by the delay element 825 (λ/4-delay).

As described above with respect to FIGS. 7 and 8, by biasing the PIN diodes 910 and 915 on or off, the phase shifter 900 can provide a straight-through path, a 180 degree phase shift between the input port and the output port, a high impedance, or a notch or band-stop filter between the input port and the output port.

Figure 10:
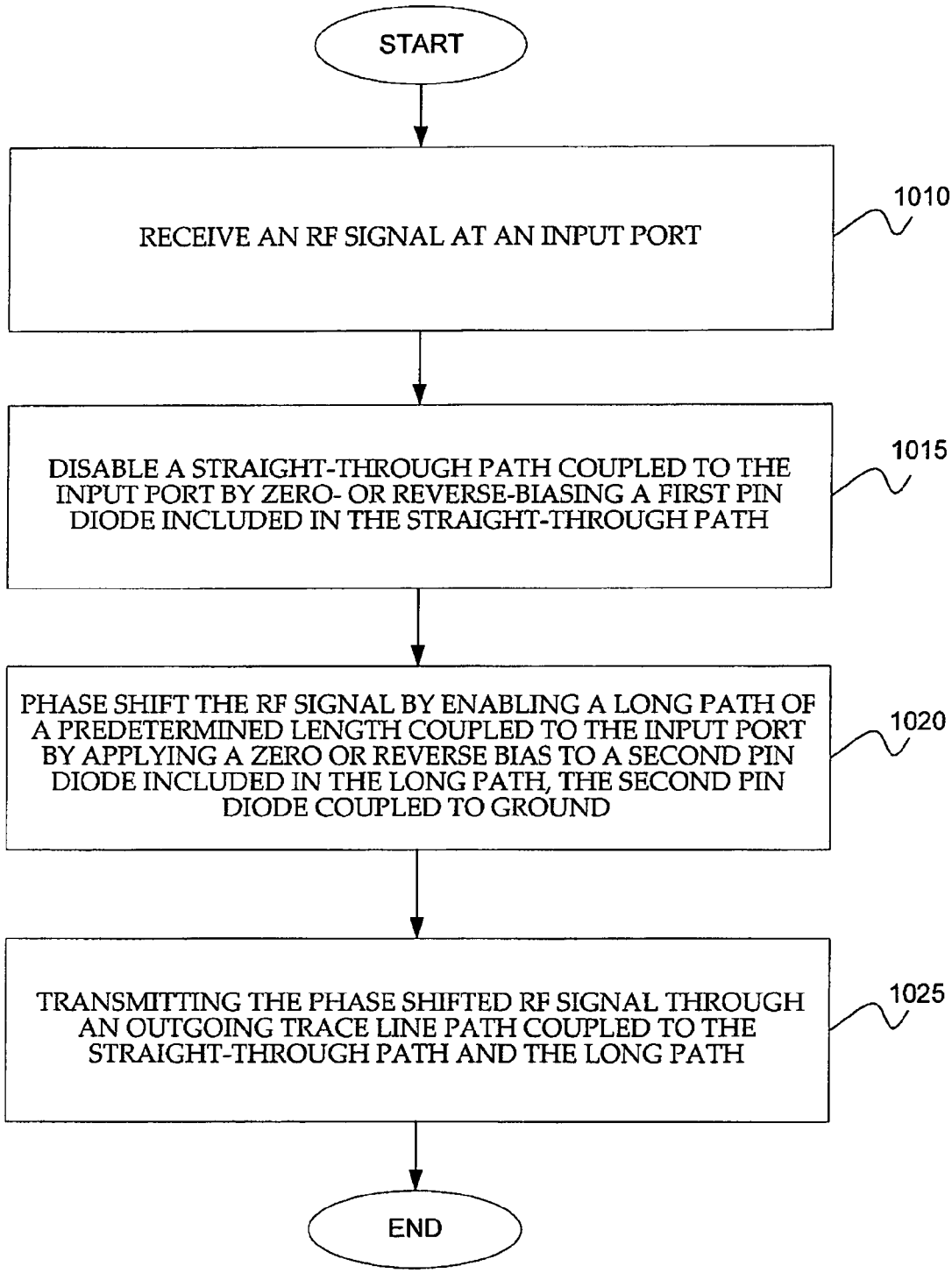
FIG. 10 illustrates a flow diagram showing an exemplary process for selectively phase shifting an RF signal according to one embodiment in accordance with the present invention.

FIG. 10 illustrates a flow diagram showing an exemplary process for selectively phase shifting an RF signal according to one embodiment in accordance with the present invention. The process, as shown in FIG. 10, may begin with "START" and end with "END." At step 1010, an RF signal is received at an input port. At step 1015, a straight-through path between the input port and an output port is selectively disabled by zero- or reverse-biasing a first PIN diode included in the straight-through path. For example, the straight-through path may include the first PIN diode 710 discussed with respect to the embodiment of FIG. 7 such that enabling the first PIN diode 710 couples the input port to the output port through the straight-through path. Disabling the first PIN diode 710 decouples or isolates the input port and the output port.

At step 1020, the RF signal is phase shifted by enabling a "long path" of a predetermined length (or delay, as length is related to delay for RF) coupled to the input port by opening (applying a zero or reverse bias to) a second PIN diode included in the long path, the second PIN diode coupled to ground. The long path may comprise the PCB trace lines 705 and 706 of ¼-wavelength, and a second PIN diode 715 at the confluence of the first trace line 705 and the second trace line 706 of FIG. 7, for example. The long path may optionally include one or more delay elements, as described with respect to FIGS. 8 and 9. As discussed herein, the predetermined length of the long path is $\lambda/2$, according to exemplary embodiments. The long path may be divided in half by the second PIN diode, such as the second PIN diode 715 discussed in FIG. 7. Accordingly, each half of the long path may be of predetermined delay=$\lambda/4$. At step 1025, the phase shifted RF signal is transmitted through an output port coupled to the straight-through path and the long path.

Selectable phase switching as described herein provides a number of advantages and is widely applicable to RF networks, just a few of which are described herein. Incorporating selectable phase switching into the circuit board 105 may allow a reduction in the number of antenna elements 240A-240G used on the circuit board 105 while still providing highly configurable radiation patterns. Further, as compared to a prior art phase shifter, selectable phase shifting as described herein reduces the number of PIN diodes used in selecting non-phase shifted or phase shifted RF paths.

The invention has been described herein in terms of several preferred embodiments. Other embodiments of the invention, including alternatives, modifications, permutations and equivalents of the embodiments described herein, will be apparent to those skilled in the art from consideration of the specification, study of the drawings, and practice of the invention. The embodiments and preferred features described above should be considered exemplary, with the invention being defined by the appended claims, which therefore include all such alternatives, modifications, permutations and equivalents as fall within the true spirit and scope of the present invention.

What is claimed is:

1. A system for selective phase shifting, comprising:

an input port configured to receive an RF signal;

a straight-through path coupled to the input port and including a first RF switch;

a long path of predetermined length coupled to the input port and including a second RF switch coupled to a ground, the long path comprising a first delay path and a second delay path;

a delay element coupled to the first and second delay paths in series with the second RF switch;

the first delay path comprising a first trace line of ¼-wavelength of the RF signal less a phase delay of the delay element;

the second delay path comprising a second trace line of ¼-wavelength of the RF signal less a phase delay of the delay element;

the first delay path and the second delay path selectively coupled to ground by application of a forward bias to the second RF switch; and an output port coupled to the straight-through path and the long path.

2. The system of claim 1 wherein the predetermined length comprises a 180 degree phase delay between the input port and the output port.

3. The system of claim 1 wherein the predetermined length comprises a multiple of 90 degree phase shift between the input port and the output port.

4. The system of claim 1 wherein the straight-through path is configured to selectively transmit the RF signal from the input port to the output port by application of a forward bias to the first RF switch.

5. The system of claim 1 wherein the long path is configured to selectively present a high impedance to both the input port and the output port by application of a forward bias to the second RF switch.

6. The system of claim 1 wherein the long path is configured to selectively receive the RF signal from the input port, apply a multiple of 90 degree phase shift to the RF signal, and transmit the phase shifted RF signal to the output port by application of an appropriate bias to the second RF switch.

7. The system of claim 1 wherein the long path is configured to selectively receive the RF signal from the input port, apply a 180 degree phase shift to the RF signal, and transmit the phase shifted RF signal to the output port by application of a zero or reverse bias to the second RF switch.

8. The system of claim 1 wherein the long path is divided in half by the second RF switch.

9. The system of claim 1 wherein the first RF switch and the second RF switch comprise PIN diodes.

10. A system for selective phase shifting, comprising:

an input port configured to receive an RF signal;

a straight-through path coupled to the input port and including a first RF switch;

a long path of predetermined length coupled to the input port and including a second RF switch coupled to a ground, the long path comprising a first half path and a second half path, the first half path including a first delay element and a first trace line of ¼-wavelength of the RF signal less a phase delay of the first delay element, the second half path including a second delay element and a second trace line of ¼-wavelength of the RF signal less a phase delay of the second delay element, the first half path and the second half path selectively coupled to ground by application of a zero or reverse bias to the second RF switch for a phase delay of ½-wavelength of the RF signal; and an output port coupled to the straight-through path and the long path.

11. The system of claim 10 wherein the long path is configured to selectively present a high impedance to the input port and the output port by application of a forward bias to the second RF switch.

12. The system of claim 10 wherein the long path is configured to selectively receive the RF signal from the input port, apply a multiple of 90 degree phase shift to the RF signal, and transmit the phase shifted RF signal to the output port by application of an appropriate bias to the second RF switch.

13. The system of claim 10 wherein the first RF switch and the second RF switch comprise PIN diodes.

14. The system of claim 10 wherein the predetermined length comprises a multiple of 90 degree phase shift between the input port and the output port.

15. The system of claim 10 wherein the straight-through path is configured to selectively transmit the RF signal from the input port to the output port by application of a forward bias to the first RF switch.

16. A method for phase shifting an RF signal, comprising:

receiving an RF signal at an input port;

disabling a straight-through path coupled to the input port by applying a zero or reverse bias to a first RF switch included in the straight-through path;

phase shifting the RF signal by enabling a long path of a predetermined length coupled to the input port by applying a zero or reverse bias to a second RF switch included in the long path, the predetermined length of the long path being a multiple of one half of a wavelength of the RF signal, the second RF switch coupled to a ground; and transmitting the phase shifted RF signal to an output port coupled to the straight-through path and the long path.

17. The method of claim 16 wherein the long path is divided in half by the second RF switch.

18. A method for phase shifting an RF signal, comprising:

receiving an RF signal at an input port;

disabling a straight-through path coupled to the input port by applying a zero or reverse bias to a first RF switch included in the straight-through path;

phase shifting the RF signal by enabling a long path of a predetermined length coupled to the input port by applying a zero or reverse bias to a second RF switch included in the long path, the long path including a delay element, the second RF switch coupled to a ground; and transmitting the phase shifted RF signal to an output port coupled to the straight-through path and the long path.

19. The method of claim 18 wherein the long path is of length equal to one half of a wavelength of the RF signal minus the phase delay presented by the delay element.

20. The method of claim 18 wherein the long path is of length equal to a multiple of one half of a wavelength of the RF signal minus the phase delay presented by the delay element.

21. The method of claim 18 wherein the predetermined length of the long path is one half of a wavelength of the RF signal.

22. The method of claim 18 wherein the long path is divided in half by the second RF switch.

23. An antenna apparatus having selectable antenna elements and selectable phase shifting, comprising:

communication circuitry located in a first area of a circuit board, the communication circuitry configured to generate an RF signal into an antenna feed port of the circuit board;

a first antenna element located near a first periphery of the circuit board, the first antenna element configured to produce a first directional radiation pattern when coupled to the antenna feed port; and a phase shifter, the phase shifter including a straight-through path configured to selectively couple the antenna feed port to the first antenna element with a first PIN diode, the phase shifter further including a long path of predetermined length configured to selectively couple the antenna feed port to the first antenna element with a second PIN diode coupled to a ground, the phase shifter configured to selectively provide a zero degree phase shift, a 180 degree phase shift, and a multiple of 180 degree phase shift between the antenna feed port and the first antenna element.

24. The antenna apparatus of claim 23, wherein the phase shifter is configured to selectively isolate the antenna feed port from the first antenna element.

25. The antenna apparatus of claim 23, wherein the phase shifter is configured to selectively provide a zero degree phase shift between the antenna feed port and the first antenna element.

26. The antenna apparatus of claim 23, wherein the phase shifter is configured to selectively provide a 180 degree phase shift between the antenna feed port and the first antenna element.

27. A system for selective phase shifting, comprising:

an input port configured to receive an RF signal;

a straight-through path coupled to the input port and including a first RF switch;

a long path of predetermined length coupled to the input port and including a second RF switch coupled to a ground, the long path comprising a first half path and a second half path, the first half path including a first delay element and a first trace line of a multiple of ¼-wavelength of the RF signal less a phase delay of the first delay element, the second half path including a second delay element and a second trace line of a multiple of ¼-wavelength of the RF signal less a phase delay of the second delay element, the first half path and the second half path with a zero or reverse bias for the second RF switch results in a multiple of phase delay of ½-wavelength of the RF signal; and an output port coupled to the straight-through path and the long path.

28. The system of claim 27 wherein the first RF switch and the second RF switch comprise PIN diodes.

29. The system of claim 27 wherein the first half path and the second half path are selectively coupled to ground by the second RF switch.

30. The system of claim 27 wherein the predetermined length comprises a multiple of 90 degree phase shift between the input port and the output port.

31. The system of claim 27 wherein the straight-through path is configured to selectively transmit the RF signal from the input port to the output port by application of a forward bias to the first RF switch.

32. The system of claim 27 wherein the long path is configured to selectively present a high impedance to the input port and the output port by application of a forward bias to the second RF switch.

33. The system of claim 27 wherein the long path is configured to selectively receive the RF signal from the input port, apply a multiple of 90 degree phase shift to the RF signal, and transmit the phase shifted RF signal to the output port by application of an appropriate bias to the second RF switch.

* * * * *